US005916436A

United States Patent [19]

Devore et al.

[11] Patent Number: 5,916,436

[45] Date of Patent: Jun. 29, 1999

[54] DRAIN TRAP

[75] Inventors: James Melvin Devore, Candler; Charles Franklin Helms, Jr., Asheville, both of N.C.

[73] Assignee: BASF Corporation, Mt. Olive, N.J.

[21] Appl. No.: 08/928,760

[22] Filed: Sep. 12, 1997

Related U.S. Application Data

[63] Continuation of application No. 08/217,464, Mar. 24, 1994, abandoned.

[51] Int. Cl.[6] ..... E03F 5/14

[52] U.S. Cl. ..... 210/163; 210/164; 210/238; 210/462; 137/247.39

[58] Field of Search ..... 210/163, 164, 210/165, 166, 238, 248, 446, 462; 404/2, 3, 4, 5; 137/247.33, 247.39

[56] References Cited

U.S. PATENT DOCUMENTS

| | | | |
|---|---|---|---|
| 301,151 | 7/1884 | Pietsch | 137/247.39 |
| 578,024 | 3/1897 | Perkes | 137/247.39 |
| 873,120 | 12/1907 | Dunstan | 210/163 |
| 1,175,836 | 3/1916 | Stubbe | 137/247.39 |
| 2,074,462 | 12/1937 | Dame | 137/247.39 |
| 3,042,210 | 7/1962 | Hattori | 210/163 |
| 4,019,326 | 4/1977 | Herveling et al. | 210/491 |
| 4,045,346 | 8/1977 | Swasky | 210/164 |
| 4,669,167 | 6/1987 | Asterlin | 210/238 |
| 4,910,811 | 3/1990 | Izzi, Sr. | 210/163 |

*Primary Examiner*—Christopher Upton

[57] ABSTRACT

A drain trap for a plumbing drainage system includes a drain pipe having an inlet end for fluid-connection to an area to be drained of liquid, and a discharge end. A drain cup is provided which includes a bottom wall and a side wall joined to the bottom wall. The side wall defines an open upper end which surrounds the discharge end of the drain pipe and is positioned within a portion of the drain cup to establish therebetween an annulus space to allow liquid flowing through the drain pipe to fill the drain cup and then overflow into plumbing associated with the drainage system. At least one pair of radially extending lugs are provided which are circumferentially spaced apart from one another about the drain pipe. The lugs are joined rigidly to both the drain pipe and the side wall of the drain cup to form an integral structure.

15 Claims, 5 Drawing Sheets

DRAIN TRAP

This is a continuation of parent application Ser. No. 08/217,464, filed Mar. 24, 1994, now abandoned.

FIELD OF THE INVENTION

The present invention relates to drain traps. More specifically, the present invention relates to a removable drain trap which is suitable for installment in both existing and new sewage system pipes.

BACKGROUND OF THE INVENTION

Drain traps are widely used in commercial, residential and industrial applications, and generally serve two purposes. One purpose which drain traps serve is to provide a seal to prevent odor, toxic and/or explosive gases from escaping the sewage system. Another purpose for drain traps is to retain small objects which may fall into the drain.

One common type of a drain trap is a U-shaped drain pipe. The main disadvantages of these drain pipes are that the U-shaped pipe needs extra space and is difficult to install in existing sewage systems which do not have a drain trap.

One object of the present invention is therefore to provide a drain trap which is easy to install even in existing sewage systems.

Another object of the present invention is to provide a removable and easily cleanable drain trap.

SUMMARY OF THE INVENTION

The objects of the present invention are achieved with a drain trap, which comprises:

(a) a coupling, having an opening;

(b) a drain pipe, having an entrance and an exit, being connected with the entrance to the opening of the coupling;

(c) a drain cup, having a bottom, a wall and an opening; and (d) connecting means;

the drain cup being connected by the connecting means with the drain pipe, whereby the exit of the drain pipe is in the drain cup and below the opening of the drain cup.

DESCRIPTION OF THE PREFERRED EMBODIMENTS

Figure 1:
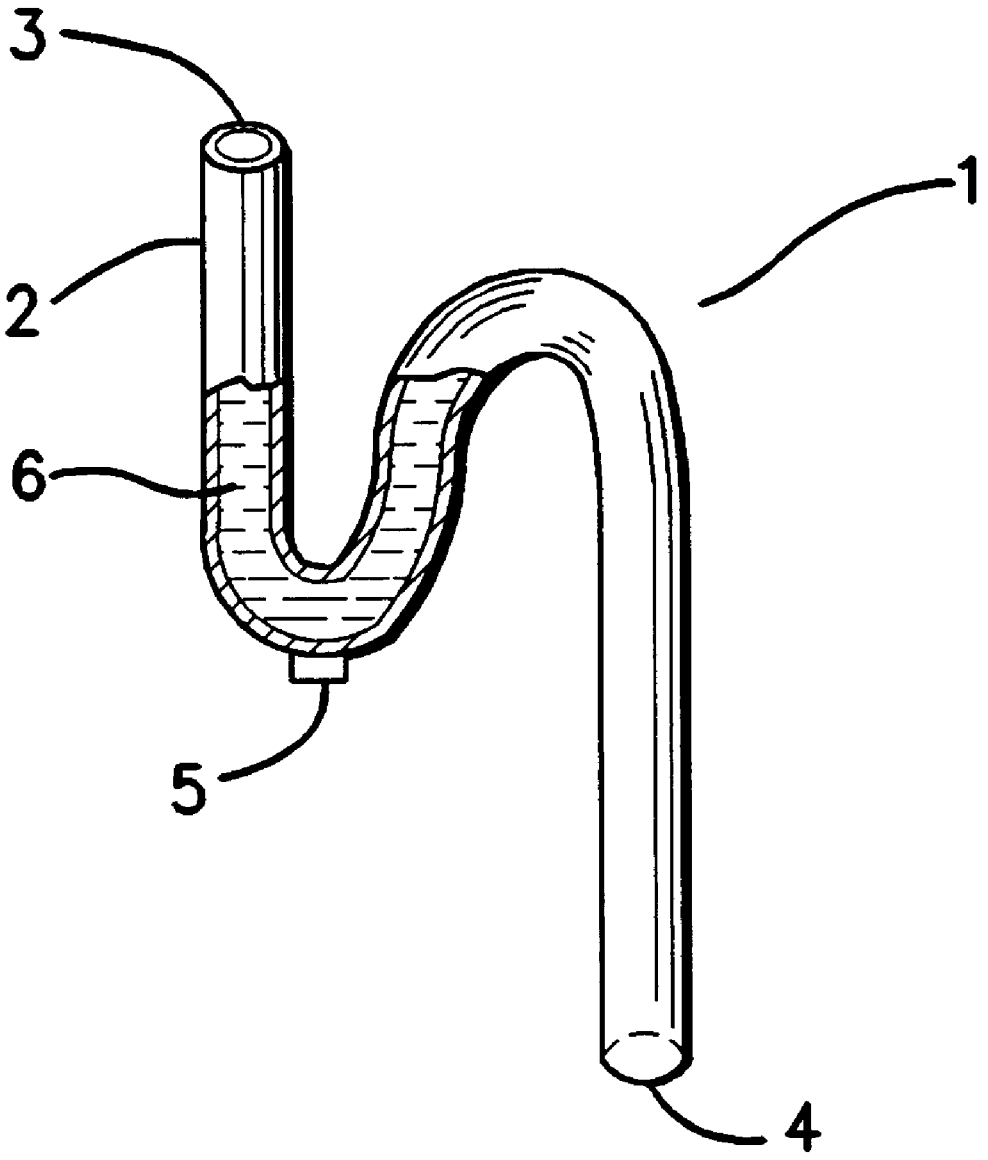
FIG. 1 PRIOR ART
FIG. 1 is a schematic view of a drain trap of the prior art.

A drain trap of the prior art is shown in FIG. 1. The drain trap (1) consists of a pipe (2) in the shape, shown in FIG. 1, which has an entrance (3), an exit (4) and a removable plug (5) for cleaning the U-shaped part of the drain trap (1).

The drain trap is installed in the vicinity of a drainage area so as to direct the liquid from the drainage area to the sewage system.

Liquid from the drainage area thus enters the entrance (3) of the drain trap (1) filling the U-shaped part of the pipe (2) and then exits over exit (4) into the sewage system.

A portion of the liquid (6) remains in the drain trap (1) and serves as a fluid sealing medium to prevent odor, toxic and/or explosive gases from escaping the sewage system.

Figure 2:
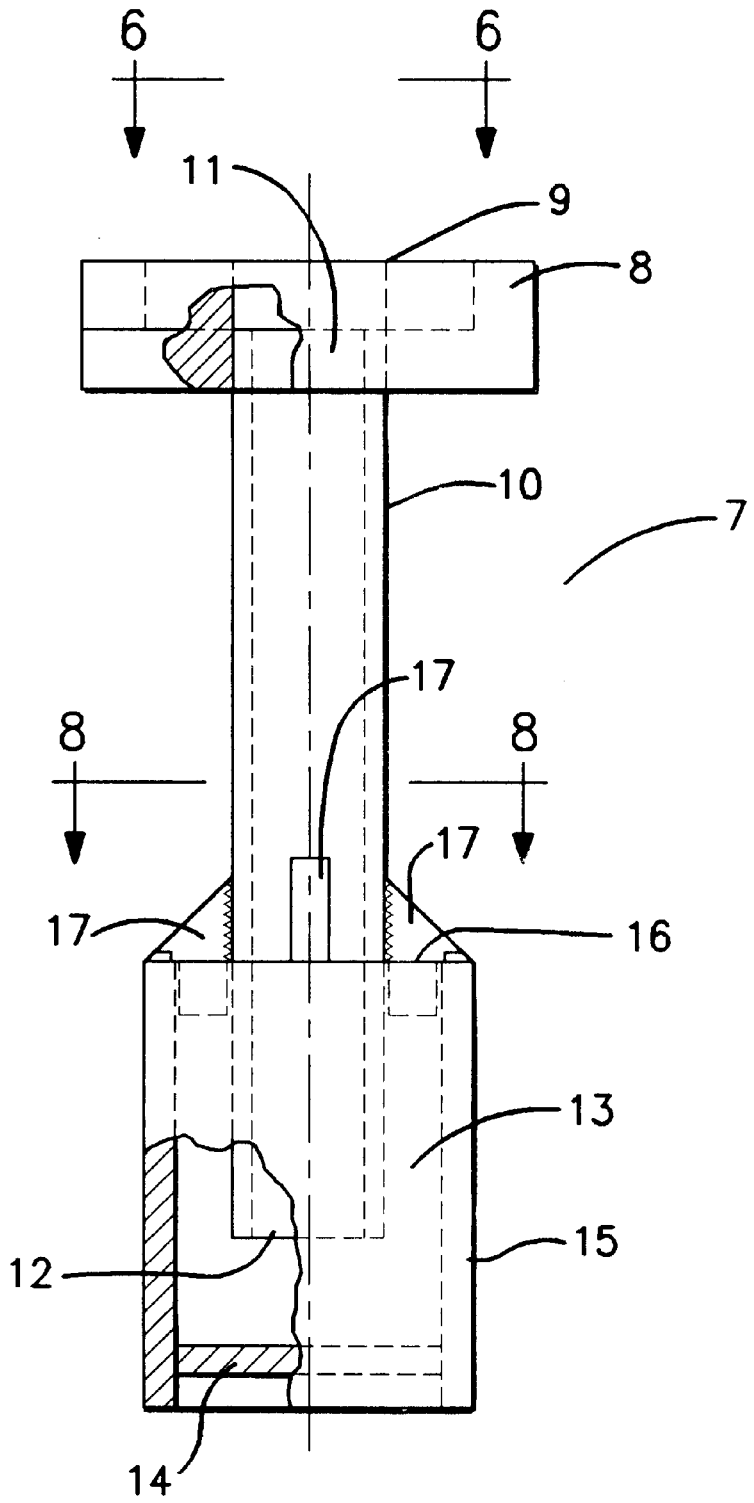
FIG. 2 is a schematic view of a drain trap of the present invention.

The drain trap of the present invention is described with reference to FIGS. 2 to 10:

As shown in FIG. 2, the drain trap (7) according to the present invention includes a coupling (8), which has an opening (9) preferably in the center, a drain pipe (10), which has an entrance (11) and an exit (12) and which is connected with the entrance (11) to the opening (9) of the coupling (8), and a drain cup (13), which has a bottom (14), a wall (15) and an opening (16) and which is connected to the drain pipe (10) by three lugs (17), whereby the exit (12) of the drain pipe (10) is located in the drain cup (13) below the opening (16).

Figure 3:
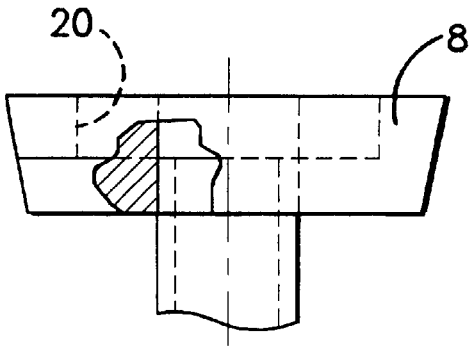
FIG. 3 is a schematic view of a detail of the drain trap of FIG. 2, which is a coupling in a conical cylindrical shape.

The coupling (8) allows a fluid to be drained to enter the drain pipe and preferably has a circular cylindrical shape, but other shapes like a conical cylindrical shape as shown in FIG. 3 or a polygon or a polygon with tapered walls are also suitable. Preferably the coupling (8) has means for removably connecting it to the entrance of a pipe of a sewage system.

Figure 4:
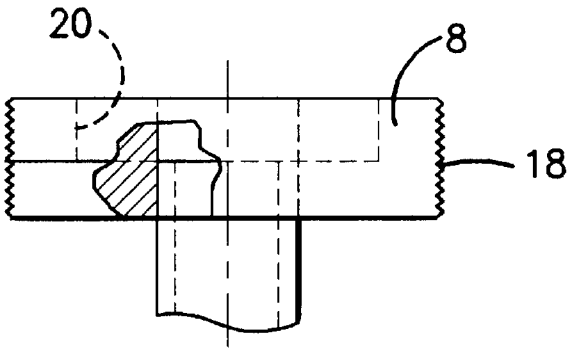
FIG. 4 is a schematic view of a coupling in a circular cylindrical shape with a thread (18).
Figure 5:
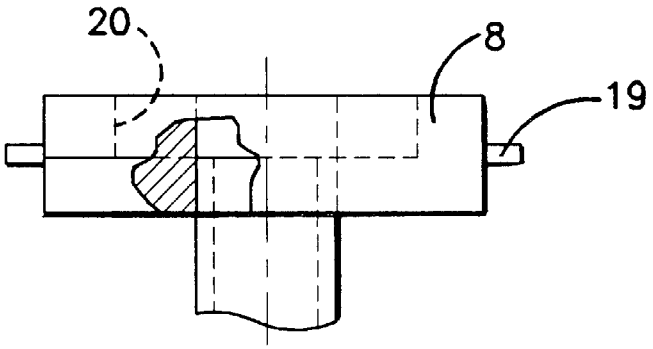
FIG. 5 is a schematic view of a coupling in a circular cylindrical shape with two pins (19).

These means comprise, for example, a thread (18) as shown in FIG. 4, pins (19) as shown in FIG. 5, a locking socket, gasket or elastomeric seal.

Figure 6:
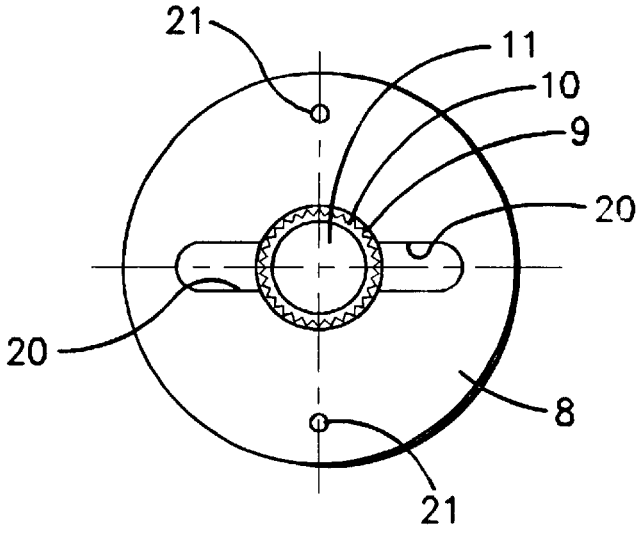
FIG. 6 is a top view of the drain trap shown in FIG. 2 along the section 6—6.
Figure 7:
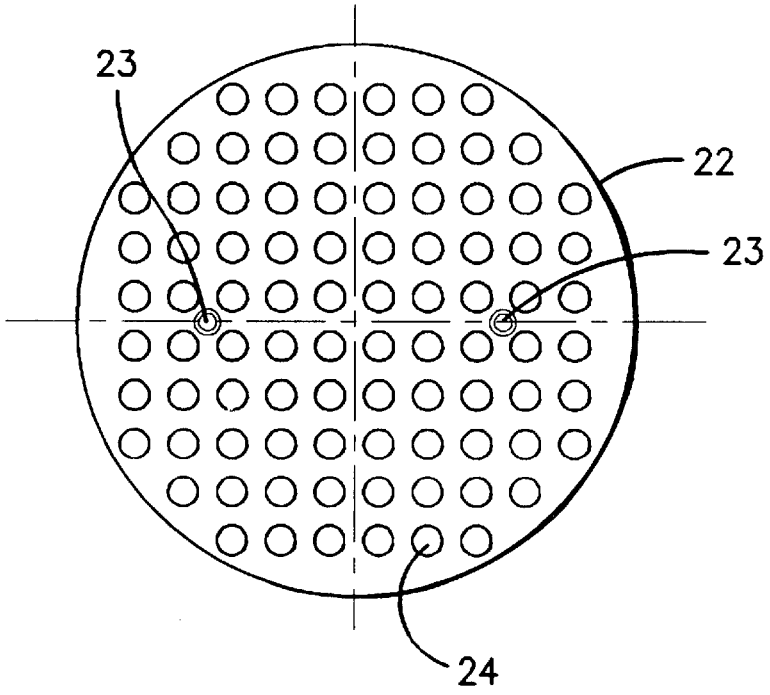
FIG. 7 is a top view of a drain cover.

Preferred is a thread (18) for removably connecting the drain trap (7) to the entrance of a pipe of a sewage system. A top view of the coupling (8) in FIG. 6 shows the opening (9), to which the entrance (11) of the drain pipe (10) is connected.

A slot (20) is one of the suitable means for removing the drain trap (7) from a pipe of a sewage system. Other suitable means are holes, grips, handles, keys and holes and a polygon socket. The optional threads (21) are suitable for the connection to the holes (23) of an optional drain cover (22) by screws inserted through holes (24) shown in FIG. 7. The optional drain cover (22) may have all kinds of shapes end openings known to those persons skilled in the art.

The pipe (10) is connected with its entrance (11) to the opening (9) of the coupling (8) by connecting means like a thread, a weld, a gluejoint, an interference fit for a tight fit, a flange for a bolted or quick connect or the pipe (10) is integrated to the coupling (8) as one piece.

The pipe (10) is connected with its exit and to the drain cup (13) by connecting means like a lug, pins, supports, wires, and spokes in such a way that the exit (12) of pipe (10) is located in the drain cup (13) below the opening,(16) of the drain cup (13). Suitable are from about 1 to about 6 connecting means, preferably from about 2 to about 3, most preferred are three connecting means.

Figure 8:
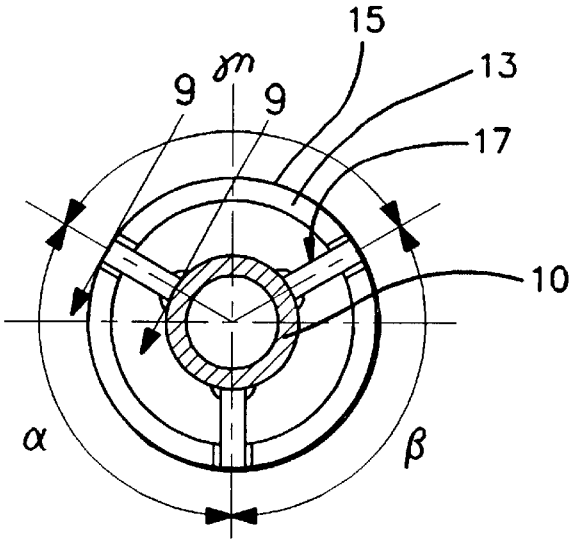
FIG. 8 is a cross sectional view of the drain trap shown in FIG. 2 along the section 8—8.

A top view of a cross section of the drain pipe (10), the drain cup (13) with the wall (15) and the three lugs (17) is shown in accompanying FIG. 8. As is seen, the wall (15) has preferably a circular shape but a polygon shape is also suitable. The angles $\alpha$, $\beta$ and $\gamma$ between two respective lugs are from about 90 to about 180°, preferably from about 100 to about 140° C. most preferred from about 110 to about 130°.

Figure 9:
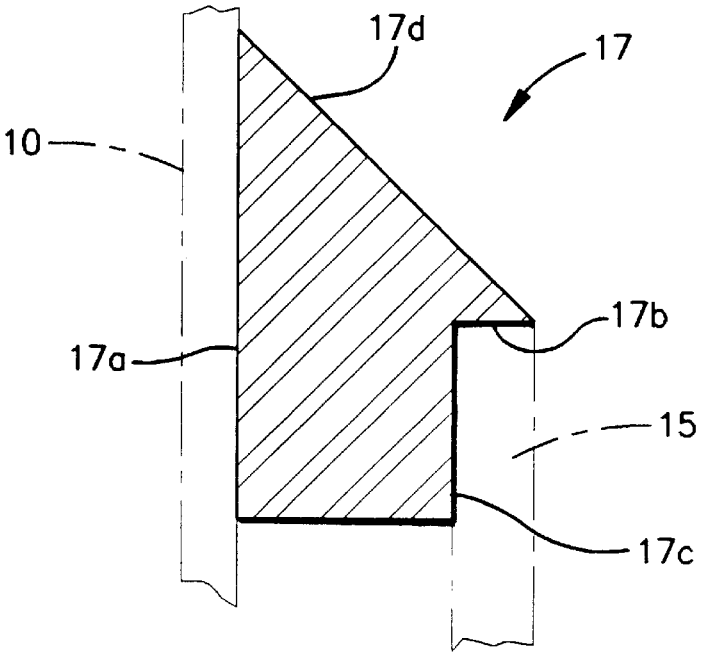
FIG. 9 is a cross sectional view of a cup support shown in FIG. 8 along the section 9—9.

FIG. 9 shows one example of a lug (17) along the section 9—9, shown in FIG. 8. As is seen, the lug (17) includes an interior vertical edge (17*b*) which is positioned against and joined to the exterior surface of the drain pipe 10. An inverted L-shaped cut-out formed of a horizontal ledge surface (17*b*) and a vertical exterior edge (17*c*) accommodate the upper end of the wall (15) of the drain cup (13). A tapered upper edge (17*d*) provides a transition between the drain pipe (10) and the wall (15) of the drain cup (13).

In case of a circular shape of the coupling and drain cup wall the diameter ratio of drain pipe: drain cup: coupling is from about 0.1 to 0.7:0.7 to 0.9:1, preferably from about 0.4 to 0.7:0.8 to 0.9:1.

The drain trap of the present invention is suitable for installment in already available pipes of a sewage system or for new installments of drain traps for commercial, residential or industrial applications like parking lots, floors, sinks, shower and stalls. The areas may be drained from anorganic or organic liquids like water, gasoline, oil, anti-freeze, and liquid gases.

The drain trap (7) of the present invention is preferably installed removably with the coupling (8) in a pipe of a sewage system and functions as follows. The liquid to be drained enters the drain trap (7) over the entrance (11) of drain pipe (10). The liquid then flows through drain pipe (10) and is discharged at exit (12) into the drain cup (13). The liquid fills the drain cup (13) until it overflows through the opening (16) over the wall (15) of the drain cup (13) into the pipe of the sewage system. Once all the liquid is drained and the liquid flow has stopped, the drain cup (13) still remains full of liquid, which serves as a sealing medium to prevent odor, toxic and/or explosive gases from escaping from the sewage system. Another function of the drain cup (13) is the retaining of small objects, which fall into the entrance (11) of the drain pipe (10) and into the drain cup (13).

In order to remove these objects and to clean the drain trap (7) including the drain cup (13), the drain trap (7) is removed from the pipe of the sewage system, cleaned and installed again for further use.

Suitable materials for the manufacture of the drain trap of the present invention are metals, polymers, ceramics and the like. Suitable metals include steel, stainless steel, aluminum, copper, lead, brass, and bronze.

Suitable polymers are polyvinylchloride (PVC), polyamides like nylon 6 and nylon 6,6, polyolefins like polyethylene, (LDPE), (HDPE), polypropylene and copolymers thereof and polyesters like polybutylene terephthalate (PBT).

Suitable ceramics are clays and porcelains.

Preferred is steel, copper, PVC and polyethylene.

We claim:

1. A drain trap for a plumbing drainage system comprising:

a drain pipe having an inlet end for fluid-connection to an area to be drained of liquid, and a discharge end;

a drain cup having a bottom wall and a side wall joined to said bottom wall, said side wall defining an open upper end which surrounds said discharge end of said drain pipe such that said discharge end of said drain pipe is positioned within a portion of said drain cup and establishes therebetween an annulus space to allow liquid flowing through said drain pipe to fill said drain cup and then overflow said drain cup into plumbing associated with the drainage system; and at least one pair of circumferentially spaced-apart lugs which radially extend from said drain pipe, said at least one pair of lugs being joined to both said drain pipe and said side wall of said drain cup so as to form an integral drain trap unit, wherein each said lug includes an interior edge joined to said drain pipe, and a cut-out portion defined by a horizontal ledge and a vertical exterior edge, said cut-out portion accommodating an upper portion of said side wall.

2. The drain trap as in claim 1, wherein said at least one pair of lugs is circumferentially spaced apart from one another by an angle of between 90° to 180°.

3. The drain trap as in claim 1, which includes three said lugs which are substantially equally circumferentially spaced-apart from one another.

4. The drain trap as in claim 1, wherein said inlet end of said drain pipe includes a coupling assembly for coupling said drain pipe to plumbing associated with the drainage system.

5. The drain trap as in claim 4, wherein said coupling assembly includes a coupling having an opening which is connected to said inlet end of said drain pipe.

6. The drain trap as in claim 5,wherein said coupling includes a slot to allow disassembly of said coupling.

7. The drain trap as in claim 5, wherein said coupling assembly includes a drain cover connected to said coupling in covering relationship to said opening thereof.

8. The drain trap as in claim 5, wherein said drain pipe, drain cup and coupling assembly have circular cross-sections, wherein said drain pipe and said coupling assembly have a diameter ratio of the drain pipe to the coupling assembly of 0.1–0.7 to 1, and wherein said drain cup and coupling assembly have a diameter ratio of the drain cup to the coupling assembly of 0.7–0.9:1.

9. The drain trap as in claim 8, wherein the diameter ratio of the drain pipe to the coupling assembly is 0.4–0.7 to 1, and wherein the diameter ratio of the drain cup to the coupling assembly is 0.8–0.9:1.

10. The drain trap as in claim 5, wherein said coupling has a circular, cylindrical, conical or polygonal shape.

11. The drain trap as in claim 1, wherein at least one of said drain pipe, drain cup and lugs is formed of a material selected from the group consisting of metals, polymers and ceramics.

12. The drain trap as in claim 1, wherein at least one of said drain pipe, drain cup and lugs is formed of a metal selected from the group consisting of steel, stainless steel, aluminum, copper, lead, brass and bronze.

13. The drain trap as in claim 1, wherein at least one of said drain pipe, drain cup and lugs is formed of a plastics material selected from the group consisting of polyvinyl chloride, polyamide, polyolefins, polyesters, copolymers and mixtures thereof.

14. The drain trap as in claim 1, wherein at least one of said drain pipe, drain cup and lugs is formed of a ceramic material selected from the group consisting of clay and porcelain.

15. The drain trap as in claim 1, wherein said side wall has a circular, cylindrical or polygonal shape.

* * * * *